US006330730B1

(12) United States Patent
Davies et al.

(10) Patent No.: US 6,330,730 B1
(45) **Date of Patent: *Dec. 18, 2001**

(54) TOOTHBRUSH

(75) Inventors: Richard Huw Davies; Derek Guy Savill, both of Bebington; Paul Jones, Childwall, all of (GB)

(73) Assignee: Chesebrough-Pond's USA Co., division of Conopco, Inc., Greenwich, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/124,266

(22) Filed: Jul. 29, 1998

(30) Foreign Application Priority Data

Aug. 1, 1997 (GB) ..... 9716397

(51) Int. Cl.[7] ..... A46B 9/04
(52) U.S. Cl. ..... 15/167.1; 15/105; 116/212
(58) Field of Search ..... 15/105, 167.1, 15/201; 116/200, 201, 208, 212; 434/263

(56) References Cited

U.S. PATENT DOCUMENTS

| | | | | |
|---|---|---|---|---|
| 2,882,544 | * | 4/1959 | Hadidian | 15/167.1 |
| 2,935,755 | * | 5/1960 | Leira et al. | 15/167.1 |
| 3,224,316 | * | 12/1965 | Grikscheit et al. | 116/212 X |
| 3,493,991 | * | 2/1970 | De Bianchi | 15/143.1 |
| 4,716,614 | | 1/1988 | Jones et al. | 15/105 |
| 4,744,124 | | 5/1988 | Wang et al. | 15/105 |
| 5,115,533 | | 5/1992 | Hukuba | 15/105 |
| 5,282,291 | | 2/1994 | Spieler et al. | 15/167.1 |
| 5,315,732 | * | 5/1994 | Huefner et al. | 15/167.1 |
| 5,355,544 | | 10/1994 | Dirksing | 15/105 |
| 5,502,861 | | 4/1996 | Spieler et al. | 15/167.1 |

FOREIGN PATENT DOCUMENTS

| | | | | |
|---|---|---|---|---|
| 2 236 071 | | 3/1991 | (GB) . | |
| 6-245815 | * | 9/1994 | (JP) | 15/167.1 |

* cited by examiner

*Primary Examiner*—Mark Spisich
(74) *Attorney, Agent, or Firm*—Milton L. Honig

(57) ABSTRACT

A toothbrush incorporating an indicator comprising a pressure indicating material which provides an optical signal without the provision of a power supply. Preferably, the pressure sensitive material is a piezochromic material, such as a liquid crystal cholesterol ester.

10 Claims, 2 Drawing Sheets

TOOTHBRUSH

BACKGROUND OF THE INVENTION

1. Field of the Invention

This invention relates to a toothbrush, and in particular to a toothbrush which incorporates a device to indicate to the user that excessive force is being applied during brushing.

2. The Related Art

It is widely appreciated that people cause serious damage to their teeth and gums by brushing too hard, and there have been a number of designs of toothbrush aimed at overcoming this problem. Several studies have arrived at the conclusion that excessive pressure during brushing leads to recession on premolars, and also gingival recession, which exposes the underlying cementum, often leading to hypersensivity, loss of aesthetics, and may be a factor in root caries and root surface abrasion, leading to root fillings.

One solution is a brush which simply will not transmit excessive force, for example a design disclosed in DE 3 724 476 (Schliebs) where the neck of the toothbrush buckles if the user attempts to brush too hard. This, however, may result in a relatively flimsy product, which may be frustrating to use, as brushing may continually be interrupted. Another known solution is disclosed in U.S. Pat. No. 5,502,861 (Bioware) which provides a toothbrush with an indicator which signals to the user if excessive force is being applied. This has the advantage that the user is provided with a clear signal that brushing is too hard, and which can be used to learn to brush correctly. It is disclosed in U.S. Pat. No. 5,282,291 (Bioware) that it is thought preferable to make the indicator mechanism an integral part of the brush, rather than an attachment to it; the latter arrangement generally results in a brush which is awkwardly shaped and unnatural to use.

Known designs incorporating integral indicators generally use an electrical circuit of some kind. In the design disclosed in U.S. Pat. No. 5,282,291, components of the circuit are brought into contact as the brush flexes, completing the circuit and triggering the indicator. Often, the user must fit a battery to power the indicator, which battery must be small and will be difficult to fit. In designs where a battery is required, access to the circuitry must be available, for example through a removable cover. This arrangement is inevitably less hygienic; the cover is unlikely to fit exactly flush with the handle surface and so debris may collect in any gap between the cover and handle and possible also in the cavity itself. The device disclosed in DE 3 724 476 avoids the problem of powering the indicator circuit by relying instead on a piezoelectric component to act as a 'mechanical-electrical convertor' producing an electrical signal in response to the applied force. Obviously, these designs require a number of miniature components fitted into a small cavity in the-brush handle, which is likely to render them difficult and therefore expensive to manufacture. Also, it is not ideal to locate an electrical circuit in a persistently damp environment. These disadvantages can be overcome by the use of an indicator which does not require a separate power source or complex circuitry and can be incorporated easily into the body of the brush.

SUMMARY OF THE INVENTION

Thus, according to a first aspect of the invention there is provided a toothbrush incorporating an indicator comprising a pressure indicating material which provides an optical signal without the provision of a power supply, such as batteries or the electricity mains. Thus, the user can be provided with a visual indication when excessive brushing force is being used. Highly preferably, the pressure indicating material is one which provides an optical signal or response to indicate to the user when too much brushing pressure is being applied, but then may relax to its original state, e.g. colour, after a period of time. This may or may not be after the user has finished a normal brushing regime. As such, the relaxation time of the material providing the optical response may typically be in the region of 1 second to 24 hours, though it is preferably long enough for the user to register it, and is preferably less than 24 hours.

Preferably, the pressure indicating material is a piezochromic material.

The pressure indicating material according to the invention, which is preferably a piezochromic material, is a material susceptible to show an optical response upon the application of pressure.

The pressure indicating material may be a material, such as a molybdenum carbonyl, which is susceptible to changes in solvent polarity upon the application of pressure resulting in a change in colour.

In a preferred embodiment the pressure indicating material is a shear sensitive material, for example a liquid crystal or a liquid crystal blend.

The pressure indicating material may also be a material susceptible to conformational changes or structural re-arrangements upon the application of pressure, for example, crystals of toluene sulphonate diacetylene polymers; or co-polymers containing poly(diacetylenes) or poly (silylenes). Again, the pressure indicating material may be one susceptible to relative changes in refractive index upon the application of pressure, for example aromatic solvents containing poly(N-methyl acrylamide).

In another embodiment, the pressure indicating material may be one triggered to respond as a result of the pressure sensitivity of a material or materials. For example, the pressure indicating material may be a thermochromic material susceptible to a variation in temperature brought about by conduction from a further material whose temperatures varies in dependence upon the pressure applied thereto.

In yet another embodiment, the pressure indicating material may be one susceptible to a variation in electric current generated by a piezoelectric material. In this case, the pressure indicating material will display an optical response (for example a colour change) within the range of pressure generated by brushing, this pressure range being possibly amplified or reduced, and not being affected by the range of temperatures to which the brush will be routinely subjected.

In a preferred embodiment, the piezochromic material is a liquid crystal cholesterol ester. Such a material is commercially available from Hallcrest Liquid Crystal Technology Ltd, Unit 9, Stepnell Reach, 541 Blandford Road, Hamworthy, Poole, Dorset BH16 5BW. Many mixtures are available which differ in colour and physical characteristics. Examples include the CN series, e.g. CN/R1, CN/R2, CN/R3 and CN/G1 which comprise a mixture of cholesteric liquid crystals such as cholesteryl nonanoate, cholesteryl chloride, cholesteryl oleyl carbonate, cholesteryl 2,4 dichlorobenzoate.

It is envisaged that any suitable mixture of shear sensitive liquid crystal cholesteryl esters may be used in this invention.

This material displays an optical response (a colour change) within the range of pressure generated by brushing, and is not affected by the range of temperature to which a brush is normally subjected. A further advantage is that this material can relax to its original state reasonably quickly. An indicator substance which requires a period of days to recover would not be suitable for the present application. It has, however, been found useful to use a material for providing the optical response which demonstrates a degree of hysteresis.

Once the optical indicator has been triggered, the signal is preferably long enough so that the user can remove the brush from his mouth to inspect it. Typically, this period is in the range of from 1 second to 24 hours. This property allows the brush of the present invention to overcome another of the problems inherent in earlier designs, by ensuring that the indicator is easily visible to the user. When a brush is in use, it is partially inserted into the mouth and, generally, a significant proportion of the handle is covered by the user's hand. This means that a visual indicator integral with the brush is difficult to see during brushing, and that the user may have to rely on looking in the mirror. If, however, the indicator persists to signal for a predetermined time after brushing has stopped, then it can be more easily inspected.

It is envisaged that the relaxation period of the indicator material may be such that only a single indication after use can be provided. For example, the period may be anything more than 1 min, i.e. the brush indicates during brushing that brushing has been too aggressive. The indicator material indicates to the user that brushing has been too aggressive and remains in this state for up to 10 hours. It relaxes in time for the user to brush less aggressively on the next occasion.

It is also possible that the relaxation period may be quite short, e.g. 10 seconds. This would allow the user to change his brushing technique during brushing and be able to ascertain whether the change was beneficial, i.e. less aggressive.

The relaxation period may be so short that changes in brushing technique are quickly represented by the indicator material and several changes in brushing technique may be made.

In the known designs, a separate mechanism is used to trigger the indicator, for example a predetermined flexure of the brush or movement of the bristles causes two components to move relative to each other and to close an electrical circuit. In a preferred embodiment of the invention, the need for such a mechanism is avoided, as the force exerted on the brush is communicated directly to the indicator.

Less costly embodiments use a small amount of the pressure indicating material located in a pad, plate or bubble located in/on the brush head, in/on the main body of the brush, or in/on the bristles. By way of example, the optical indicator (e.g. piezochromic) material can be heat sealed into a vinyl envelope, or it can be otherwise encapsulated. Two plates of the pressure indicating material may be used, which plates are squashed together by an applied force. In one example, plates of the material are interleaved with the brush bristles. Excessive pressure applied to the bristles causes exaggerated bending of the bristles and of the plates. In an alternative embodiment, the material is formed into a resilient membrane located at the base of the bristles, with the brush head preferably being transparent to allow the pressure indicating material to be visually inspected.

In another preferred embodiment, a mechanical arrangement is provided to transmit the force to the indicator. For example, the brush may have two handle sections linked by a pivot, a portion of one of these sections extending beyond the pivot into a cavity provided in the other section. Excessive pressure causes the two sections to rotate relative to each other, in opposite directions about the pivot, such that one face of the extended portion will be brought into contact with the inner surface of the cavity in which it is located. That interior surface is provided with a pad of the pressure indicating material. Designs such as this, which employ moving elements to transmit the applied force to the indicator, have the advantage that the force may be amplified or reduced to fall within the response range of the pressure indicating material.

With regard to the other parts of the brush, the brush body may be made of materials and with methods used in the art, for example using injection molding techniques and materials such as polypropylene and polymethyl methacrylate. The bristles may be made of materials which are used in the art, including nylon and poly butylterephthalate.

BRIEF DESCRIPTION OF THE DRAWINGS

The invention will now be described in greater detail, by way of example, with reference to the drawings, in which.

DETAILED DESCRIPTION OF THE INVENTION

Figure 1:
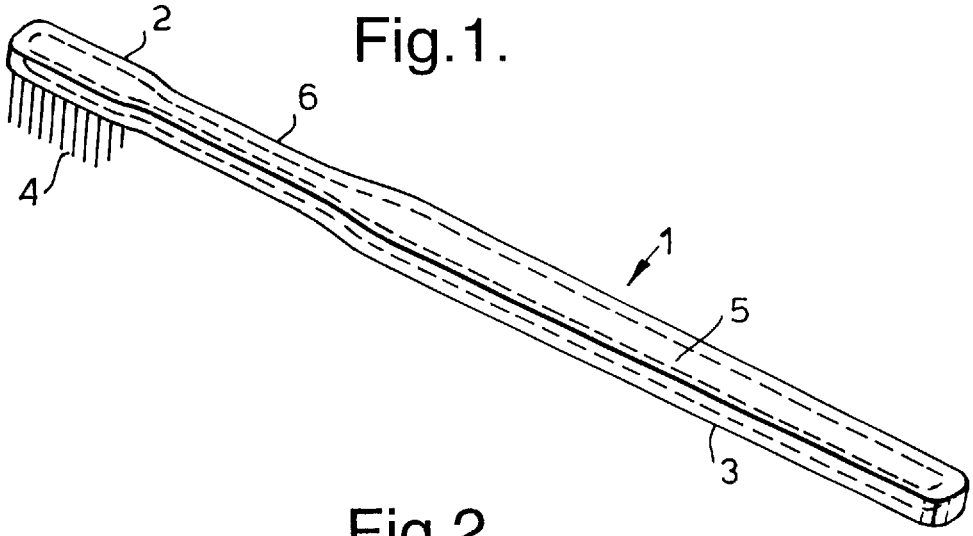
FIG. 1 is a perspective view of a first embodiment of the invention showing a brush having an internal cavity, which is completely filled with piezochromic material.

Referring to the drawings, FIG. 1 shows a toothbrush 1 having a head 2 integrally formed with a handle 3 via a neck. The head 2 is provided with bristles 4 made of nylon. The head 2 and handle 3 are made of a resilient transparent material such as polymethyl methacrylate, and define a cavity 5 extending substantially along the entire length of the brush 1. The cavity 5 is filled with a piezochromic material, in this instance liquid crystal cholesterol ester. A predetermined pressure applied to the bristles 4, or a predetermined flexure of the handle 3, will be transmitted to, and thereby cause an optical response (such as a change of colour) of, the piezochromic material. The cavity 5 may, instead of extending substantially the entire length of the brush 1, be more localised, for example, it may be confined to a neck region 6 joining the handle 3 to the head 2.

Figure 2:
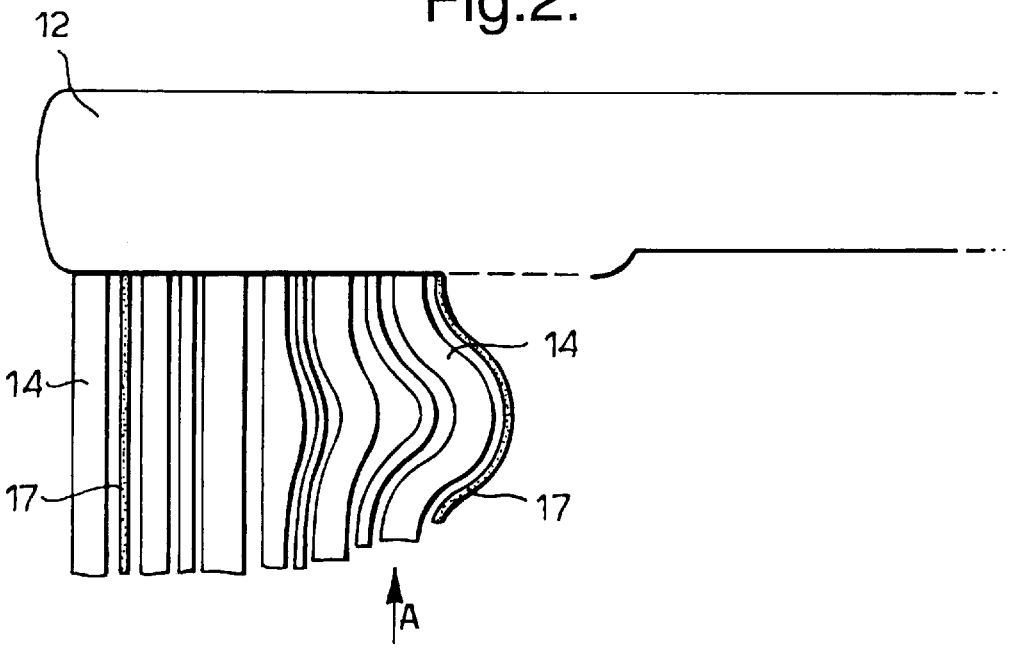
FIG. 2 is a side view of a brush head according to a second embodiment of the invention showing bristles interleaved with piezochromic plates.
Figure 3:
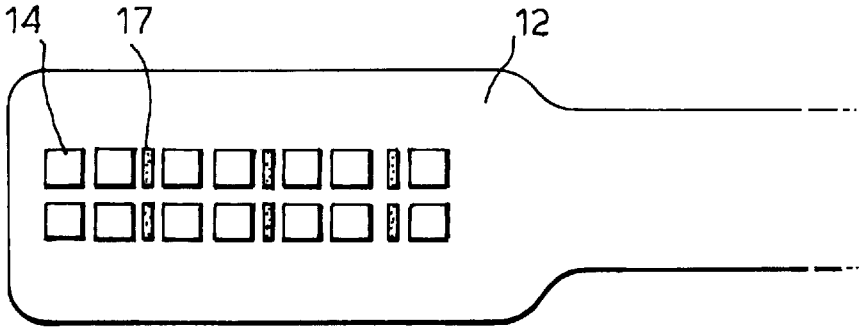
FIG. 3 is a plan view of the brush head of FIG. 2.

FIGS. 2 and 3 show respectively a side and plan view of the head 12 of a second embodiment of the invention to a larger scale. Bristles 14 are interleaved with plates 17 made of piezochromic material liquid crystal cholesterol ester. Pressure on the brush head 12 in the direction of the arrow A causes flexure of the bristles 14 and the plates 17 in the way shown, and this deformation is transmitted to the plates 17 which will cause an optical response such as a change in colour in the piezochromic material.

Figure 4:
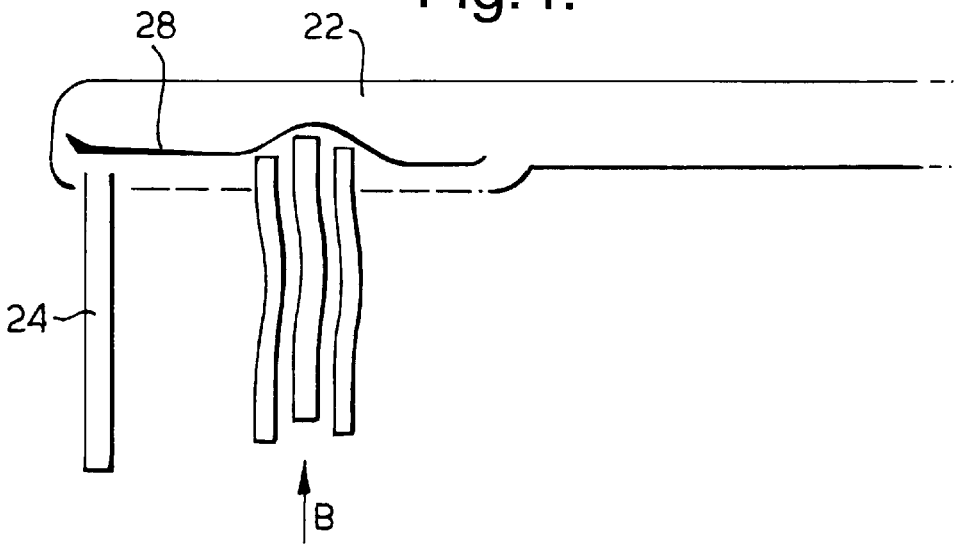
FIG. 4 is a side view of a brush head according to a third embodiment of the invention showing a membrane at the base of a bristle array.

FIG. 4 shows a side view of a third embodiment of the invention, and shows a brush head 22 provided with bristles 24. The base of each bristle 24 is attached to a flexible membrane 28 which contains the piezochromic material liquid crystal cholesterol ester. Pressure applied to the bristles 24 in the direction of the arrow B is transmitted to the membrane 28, and causes it to deform. Deformation of the membrane 28 stresses the piezochromic material contained within it, causing an optical response in the material such as a change of colour.

Figure 5:
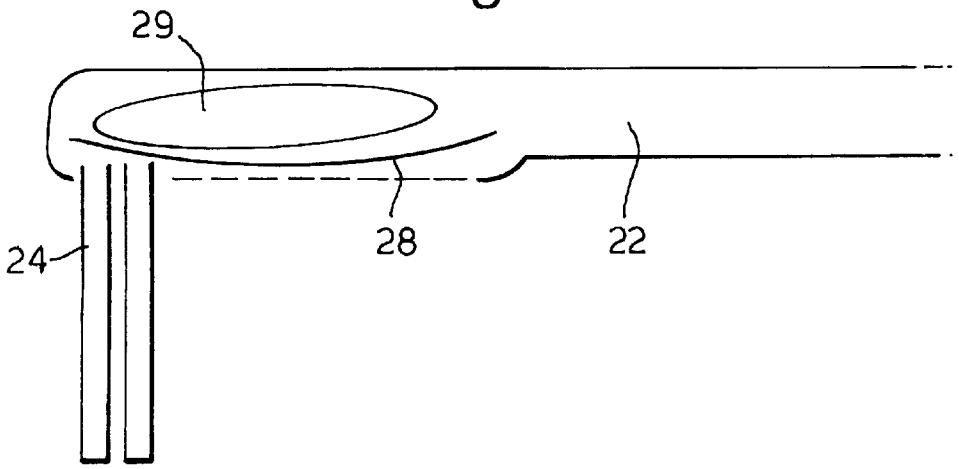
FIG. 5 is a side view of a modified version of the brush head of FIG. 4 showing the membrane replaced by a bubble of piezochromic material.

FIG. 5 shows a modified version of the brush head of FIG. 4, in which piezochromic material is contained in a sac 29. Pressure on the bristles 24 is transmitted to the sac 29 via the flexible membrane 28 causing it to deform, thereby causing an optical response in the piezochromic material such as a change of colour. In this modified brush head, the membrane 28 does not contain piezochromic material. Indeed, in a further modification, the membrane is not required, in which case pressure on the bristles 24 is transmitted directly to the sac 29.

Figure 6:
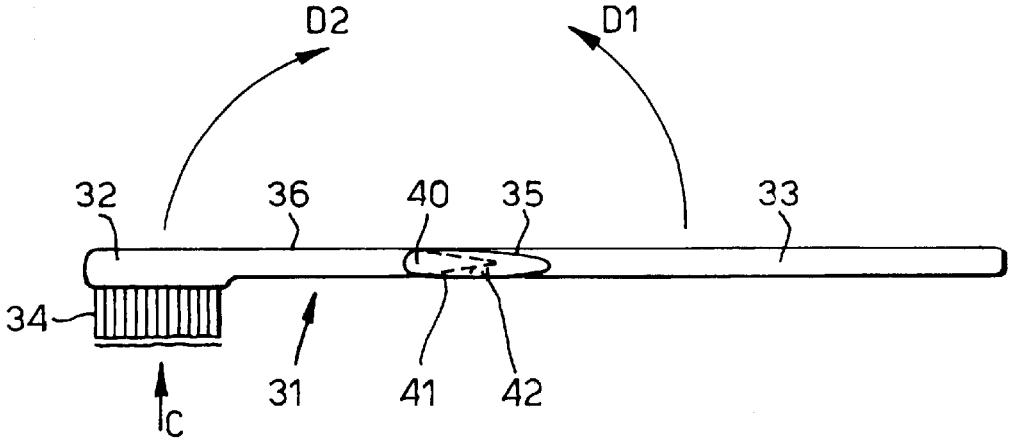
FIG. 6 is a side view of a fourth embodiment of the invention showing two handle sections linked by a pivot.

FIG. 6 shows a side view of a fourth embodiment of the invention, in which a handle 33 and a neck 36 of the brush 31 are pivotally connected at 40. A portion 41 (indicated in dotted lines) of the neck 36 extends beyond the pivot 40 into a cavity 35 formed in the handle 33. The neck 36 is integral with the head 32 of the brush 31.

In this embodiment at least the handle 33 is formed of a transparent plastics material such as polymethyl methacrylate. Pressure applied to the bristles 34 of the brush 31 in the direction of the arrow C, whilst the handle 33 is being held firmly, causes the handle and the head 32 to rotate relative to each other about the pivot 40 in the directions of the arrows D1 and D2.

Rotation is impeded as the neck portion 41 comes into contact with a pad 42 containing a piezochromic material such as liquid crystal cholesterol ester. Continued mechanical pressure on the head 32 of the brush 31 is transmitted to the pad 42 causing an optical response in the piezochromic material such as a change of colour.

It will be apparent that modifications could be made to the embodiments described above. In particular, the piezochromic material could be replaced by any material (such as a mechanochromic or thermochromic material) that alters its visual appearance in response to a mechanical strain. For example, a liquid crystal that changes colour when subjected to a mechanical strain could be used.

Alternatively, it is also envisaged that polarised materials will be used, with pieces of polarised material being configured such that their planes of polarisation are at 90° C. to each other. One of the pieces of material is fixed, and the other is able to move on the application of excessive pressure (for example by being attached to a mechanical type embodiment as described in conjunction with FIG. 6 above) such that a different orientation of polarisation planes is achieved, and thereby a colour change is observed. Otherwise, also envisaged is an embodiment of sheet form polarisors which are orientated parallel to each other, and which are separated by an arrangement such as a coiled spring and/or a helical arrangement, whereby the two polarisors are caused to rotate relative to each other when they are brought closer to or further apart from each other in response to excessive brushing pressure. As a result, the polarisors adopt a different configuration relative to each other, and a colour change is observed.

We claim:

1. A toothbrush incorporating an indicator comprising a pressure indicating material which is piezochromic and provides an optical signal without the provision of a power supply.

2. A toothbrush according to claim 1, wherein the piezochromic material is a shear sensitive material.

3. A toothbrush according to claim 2, wherein the piezochromic material is liquid crystal cholesterol ester.

4. A toothbrush according to claim 1, wherein the toothbrush comprises a handle, a neck, and a head, any of which may be manufactured of a clear material, the handle, head or neck having a cavity in which the pressure indicating material is located.

5. A toothbrush according to claim 1, wherein the toothbrush contains mechanical means by which pressure is applied to the pressure indicating material to thereby generate the optical signal.

6. A toothbrush according to claim 1, wherein the toothbrush comprises a handle, a neck, a brush head and a membrane or sac of pressure indicating material in the brush head to indicate the pressure applied.

7. A toothbrush according to claim 1, wherein the pressure indicating material has a relaxation period of between 1 second and 24 hours.

8. A toothbrush according to claim 1, wherein the pressure indicating material has a relaxation period of between 1 second and 10 minutes.

9. A toothbrush according to claim 1, wherein the pressure indicating material has a relaxation period of between 1 second and 10 seconds.

10. A toothbrush according to claim 1 which in use provides a user with an optical colour change in response to excessive brushing pressure by the user.

* * * * *